US006041450A

United States Patent [19]

Akazawa

[11] Patent Number: 6,041,450

[45] Date of Patent: Mar. 28, 2000

[54] TOILET SEAT SHEET HOLDING STRUCTURE

[76] Inventor: Yasumas Akazawa, 2-8-I4, Higashishinmachi, Matsubara, Osaka, Japan

[21] Appl. No.: 09/086,850

[22] Filed: May 29, 1998

[30] Foreign Application Priority Data

Jun. 26, 1997 [JP] Japan ..... 9-006106

[51] Int. Cl.[7] ..... A47K 13/14

[52] U.S. Cl. ..... 4/244.1; 4/245.4

[58] Field of Search ..... 4/243.1, 244.1, 4/244.3, 245.4

[56] References Cited

U.S. PATENT DOCUMENTS

| | | | |
|---|---|---|---|
| 1,376,926 | 5/1921 | Fisher | 4/243.1 |
| 3,579,669 | 5/1971 | Loewenstein | 4/244.3 |
| 5,590,424 | 1/1997 | Matsunaga et al. | 4/243.1 |

FOREIGN PATENT DOCUMENTS

| | | | |
|---|---|---|---|
| 0303323 | 2/1989 | European Pat. Off. | 4/245.4 |
| 2438932 | 4/1976 | Germany | 4/243.1 |
| 3144779 | 5/1983 | Germany | 4/243.1 |
| 3144780 | 5/1983 | Germany | 4/245.4 |

*Primary Examiner*—Charles E. Phillips
*Attorney, Agent, or Firm*—Moonray Kojima

[57] ABSTRACT

The present invention relates to a toilet seat sheet holding structure for realizing clean and sanitary use of Western style toilets installed in train, airplane, ship, bus, or other vehicles, department store, building, railway station, public toilet or other structures, and more specifically to a toilet seat sheet holding structure, in which a plurality of toilet seat sheets formed in a size to cover the sitting side are laminated and held at the back side of the toilet lid, confronting the sitting side of the toilet seat, the lowest layer of the toilet seat sheets held at the back side of the toilet lid is disposed so as to be laid on the sitting side of the toilet seat, and therefore the toilet seat sheet can be laid down correctly and securely on the sitting side of the toilet seat, without the time and labor for laying down the toilet seat sheet by hand by the user as in the prior art, the toilet seat sheet can be laid down easily and readily, and by turning the toilet lid after peeling off the used toilet seat sheet, the next layer of the toilet seat sheets is laid down on the sitting side, so that the toilet seat sheets can be replaced easily, since the user sits on the toilet seat sheet laid down on the sitting side of the toilet seat, contact with the buttocks with the toilet seat is securely prevented, so as to be used in clean and sanitary state.

4 Claims, 12 Drawing Sheets

TOILET SEAT SHEET HOLDING STRUCTURE

BACKGROUND OF THE INVENTION

1. Field of the Invention

The present invention relates to a toilet seat sheet holding structure for realizing clean and sanitary use of Western style toilets installed in train, airplanes ship, bus, or other vehicles, department store, building, railway station, public toilet or other structures.

2. Description of the Prior Art

Conventionally, when using the Western style toilet, the toilet seat sheet formed in roll or sheet is laid down on the sitting side of the toilet seat by the user, and is used by sitting on the toilet seat sheet laid on the toilet seat, so that the direct contact of the buttocks of the user with the sitting side of the toilet seat can be prevented.

However, when using by laying down the toilet seat sheet on the sitting side of the toilet seat, before use or after use, the used toilet seat sheet laid down on the toilet seat must be peeled off by hand by the user, and a new toilet seat sheet is laid down by hand by the user, it takes time and labor for replacing the toilet seat sheet, and in addition since it is used after putting the toilet seat sheet on the sitting side of the toilet seat, the setting position of the toilet seat sheet is not stable, and the direction and position of the toilet seat sheet are likely to change, and it is hard to lay down the toilet seat sheet so as to cover the sitting side of the toilet seat. Or when the user sits on the toilet seat, the toilet seat sheet may be curled up, deviated in the laying position or drop out, and the buttocks of the user may contact with the sitting side, and it may be unclean and unsanitary.

SUMMARY OF THE INVENTION

It is hence a primary object of the invention to present a toilet seat sheet holding structure, in which a plurality of toilet seat sheets formed in a size to cover the sitting side are laminated and held at the back side of the toilet lid, confronting the sitting side of the toilet a seat, the lowest layer of the toilet seat sheets held at the back side of the toilet lid is disposed so as to be laid on the sitting side of the toilet seat, and therefore the toilet seat sheet can be laid down correctly and securely on the sitting side of the toilet seat, without the time and labor for laying down the toilet seat sheet by hand by the user as in the prior art, the toilet seat sheet can be laid down easily and readily, and by turning the toilet lid after peeling off the used toilet seat sheet, the next layer of the toilet seat sheets is laid down on the sitting side, so that the toilet seat sheets can be replaced easily, since the user sits on the toilet seat sheet laid down on the sitting side of the toilet seat, contact with the buttocks with the toilet seat is securely prevented, so as to be used in clean and sanitary state.

It is other object of the invention to present a toilet seat sheet holding structure comprising sheet holding means for separating the lowest layer of the toilet seat sheets held at the back side of the toilet lid, and holding the toilet seat sheet in a state to cover the sitting side of the toilet seat, in which the toilet seat sheet is laid down and held in a state for covering the sitting side of the toilet seat by this sheet holding means, and when the user sits on the toilet seat, it securely prevents curling of the toilet seat sheet or deviation of the laying position.

It is a different object of the invention to present a toilet seat sheet holding structure, in which an adhesive having an adhesion necessary for maintaining the laminated state of toilet seat sheets is applied on the adhesive side of the toilet seat sheet, and an adhesive having an adhesion necessary for laying down and fixing the toilet seat sheet on the sitting side of the toilet seat, stronger than the adhesion of the adhesive applied on the toilet seat sheet is applied on the sitting side of the toilet seat, so that the toilet seat sheets can be securely separated into one sheet and laid down on the sitting side.

It is a further object of the invention to present a toilet seat sheet holding structure, in which an adhesive is applied on an area necessary for maintaining the laminated state of the toilet seat sheets on the adhesive side of the toilet seat sheet, and an adhesive is applied on the sitting side of the toilet seat in a range wider than the area of the adhesive applied on the toilet seat sheet and necessary for laying down and fixing the toilet seat sheet on the sitting side of the toilet seat, and therefore an adhesion necessary for separating one sheet of the lowest layer of the toilet seat sheets held on the toilet lid is obtained, and the toilet seat sheet can be laid down securely on the sitting side of the toilet seat, and curling of the toilet seat sheet or deviation of laying position can be prevented.

It is still other object of the invention to present a toilet seat sheet holding structure, in which plural laminated toilet seat sheets are held so as to be separated into one sheet each by a holding member having and opening and closing part at its lower end, and therefore plural toilet seat sheets can be held so as to be separated into one sheet each by the holding member in a simple constitution.

It is a further different object of the invention to present a toilet seat sheet holding structure, in which plural laminated toilet seat sheets are coupled up and down by a coupling piece having perforation, and therefore the lowest layer of the toilet seat sheets can be separated by tearing off the perforation by the holding force of the sheet holding means.

It is a further object of the invention to present a toilet seat sheet holding structure, in which the toilet seat sheet is formed in a size to cover the entire upper surface of the toilet seat, and the center of the toilet seat sheet is formed to be opened in a size corresponding to the inner circumferential edge of the toilet seat, and therefore it is possible to prevent the dirt from sticking to the toilet main body and the inner circumferential edge of the toilet seat, so that it can be used always in clean state.

It is a further object of the invention to present a sanitary toilet seat sheet holding structure, in which a holding unit for holding the toilet seat sheet from the sitting side of the toilet seat is formed at the end of the toilet seat sheet, and therefore the used toilet seat sheet can be sequentially peeled off by holding this holding unit by fingers, and the resistance in peeling is reduced, so that the toilet seat sheet can be peeled off easily and readily, and moreover by holding the holding unit with fingers, the used toilet seat sheet can be discarded in a waste basket, or disposed by washing away together with the dirt, and contamination of the hand or fingers with germs can be prevented securely.

Other objects of the invention will be better appreciated from the following detailed description of the drawings taken in conjunction with the accompanying drawings.

DESCRIPTION OF THE PREFERRED EMBODIMENTS

An embodiment of the invention is described specifically below by referring to the accompanying drawings.

Figure 1:
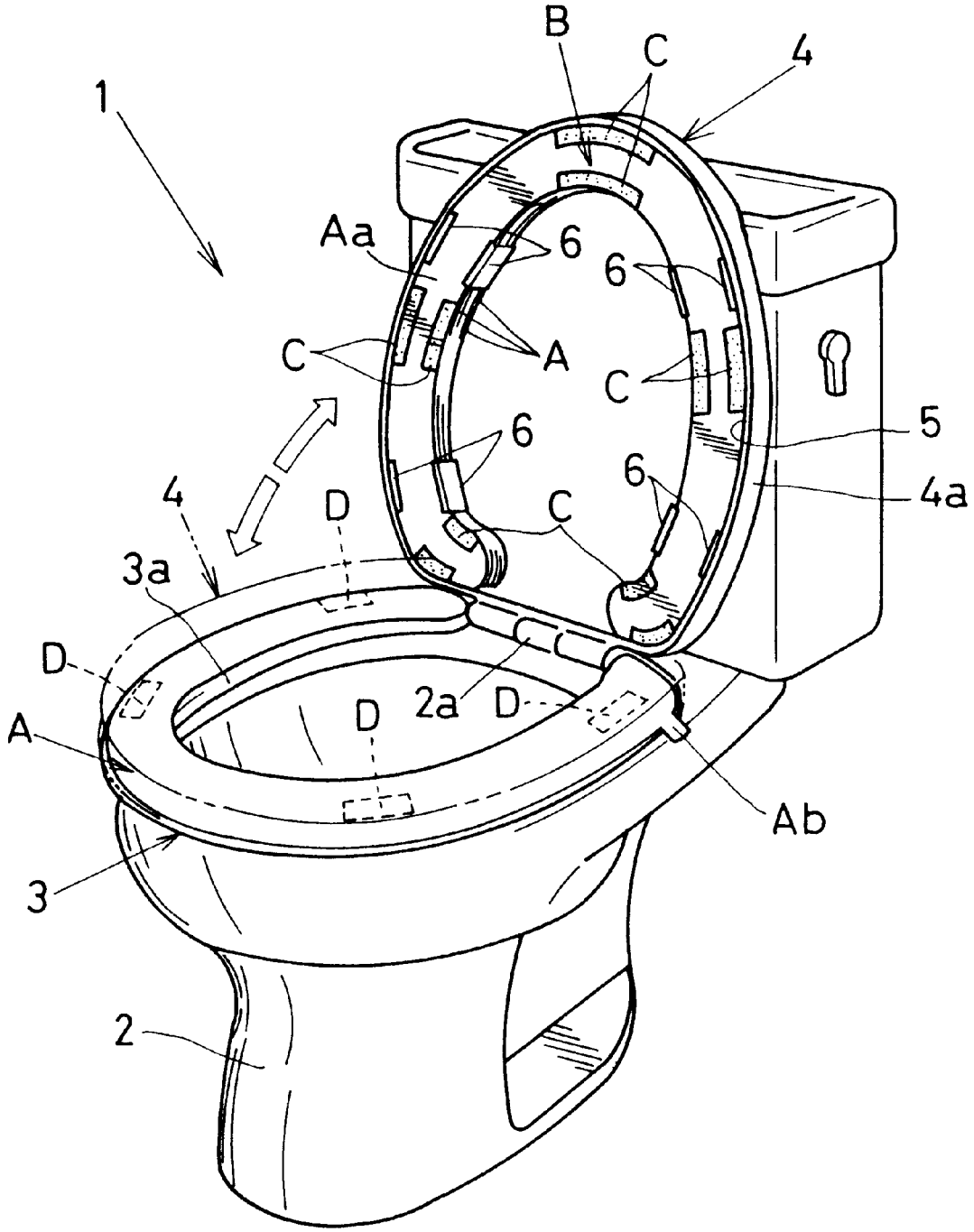
FIG. 1 is a perspective view of a Western style toilet having a toilet seat sheet holding structure of the invention.
Figure 2:
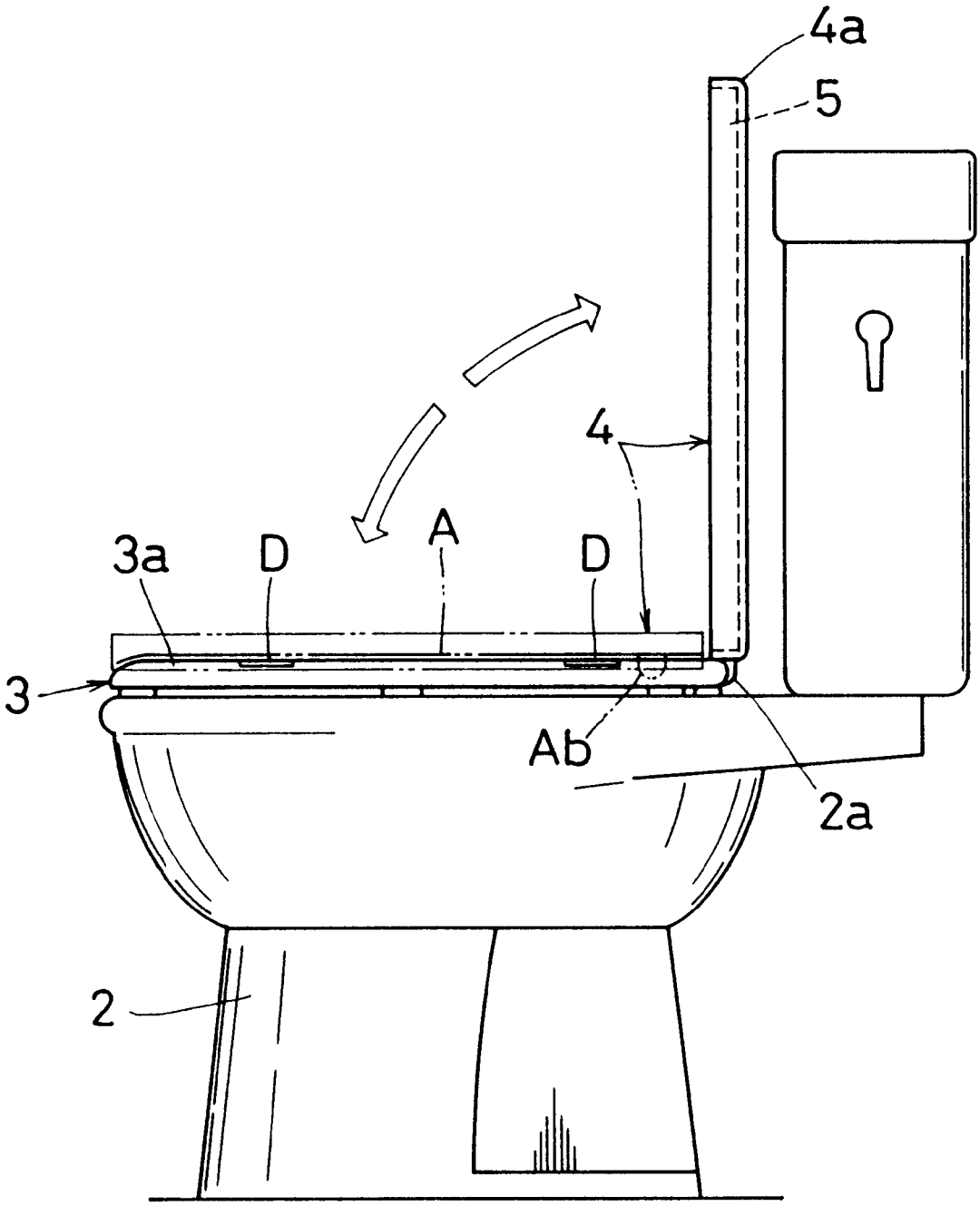
FIG. 2 is a side view showing the opening and closing actin of the toilet lid.

The drawings show a Western style toilet having the toilet seat sheet holding structure of the invention, and in FIG. 1 and FIG. 2, in this Western style toilet 1, a toilet seat 3 is supported to be opened and closed up and down on a pivot 3*a* formed at the upper edge of the rear side of a toilet main body 2, and a toilet lid 4 is supported to be opened and closed up and down on the pivot 2*a* in a size and shape to cover the entire toilet seat 3.

In the toilet lid 4, as shown also in FIG. 3 and FIG. 4, a sheet mounting unit 5 is formed opposite to the sitting side 3*a* of the toilet seat 3 at the back side of the lid main body 4*a*, and a sheet block B laminating plural (for example, five or six) or multiple (for example, ten) the toilet seat sheets A (hereinafter called sheets) is mounted on the sheet mounting unit 5.

Figure 3:
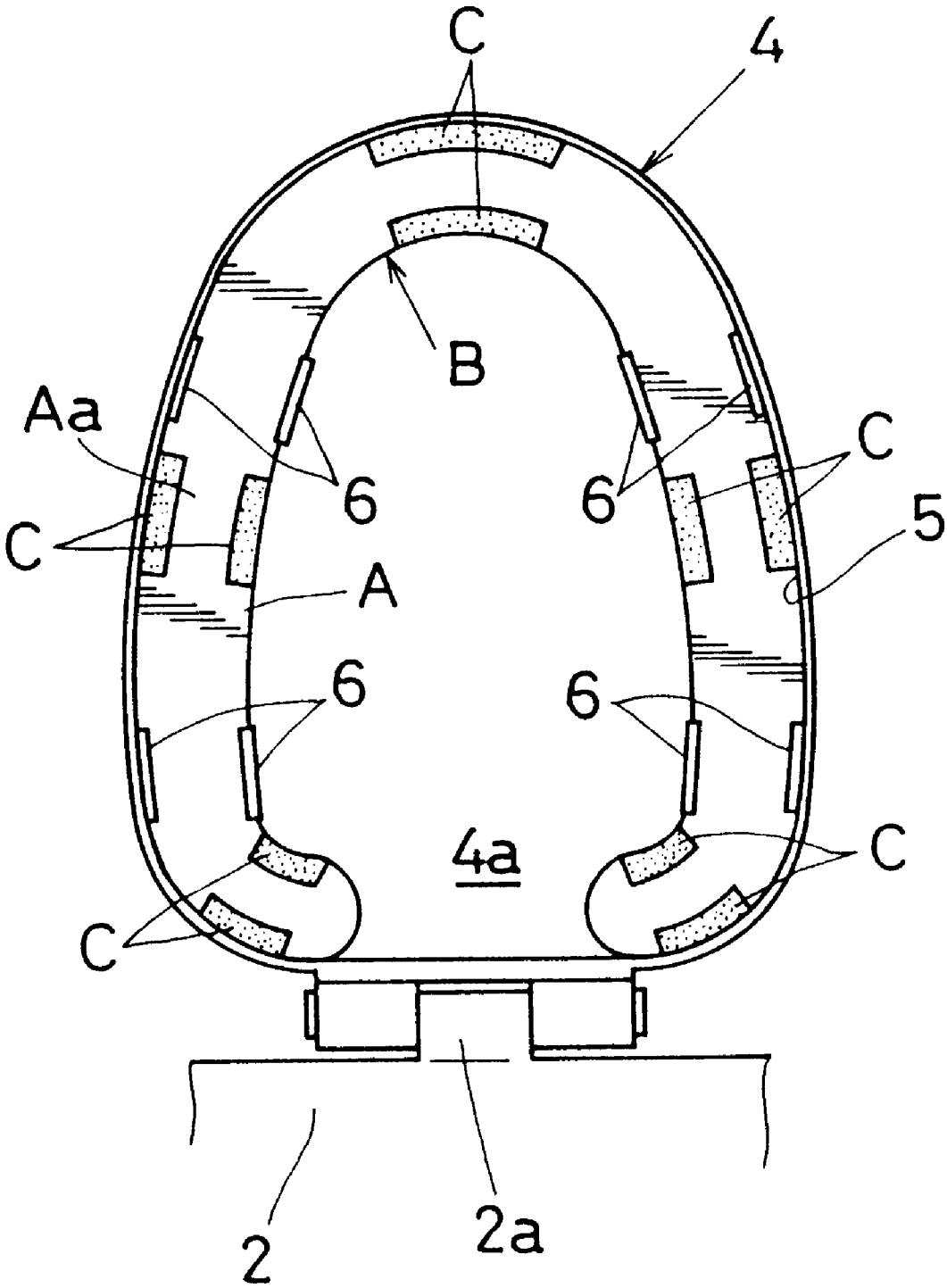
FIG. 3 is a front view showing the opened state of the toilet lid loaded with a block of sheets.

On the sheet mounting unit 5, holding pieces 6, 6 are formed at an interval for holding the edge of the sheet block B opposite to the peripheral edge of the back side of the lid main body 4*a*, and the holding pieces 6, 6 are formed at plural positions at specific intervals in the overall length of the sheet block B as shown in FIG. 3. Detent pawls 6*a*, 6*a* formed at lower ends of the holding pieces 6, 6 are arrested on the edge of the sheet A laminated in the lowest layer of the sheet block B, so that one sheet A of the lowest layer of lamination may be separated. At the upper side of the sheet A of the highest layer of lamination, a weight member 7 formed of cardboard, synthetic resin, metal or other is disposed. The weight member 7 applied weight to press the sheet A of the lowest layer in the direction of detent pawls 6*a*, 6*a* of the holding pieces 6, 6.

The sheet A is formed of, for example, water-soluble paper, or nonwoven fabric, synthetic resin, or chemical fiber or other material in a sheet, in a size and shape corresponding to the toilet seat 3, and is formed in a size so as to cover the entire sitting side 3*a* of the toilet seat 3. At the edge (rear end or front end) of the sheet A, a tab Ab (see FIG. 1) is formed for holding by finger when separating the used sheet A from the toilet seat 3. The sheet A itself may be processed by deodorizing treatment, sterilizing treatment, antibacterial treatment, etc.

At the adhesive side Aa or the lower side of the plural sheets A forming the sheet block B, an adhesive C is applied in part or in whole opposite to the upper surface of the sheet A laminated at the lower layer side. This adhesive C is set at an adhesion necessary for maintaining the laminated state of the sheets A.

Figure 5:
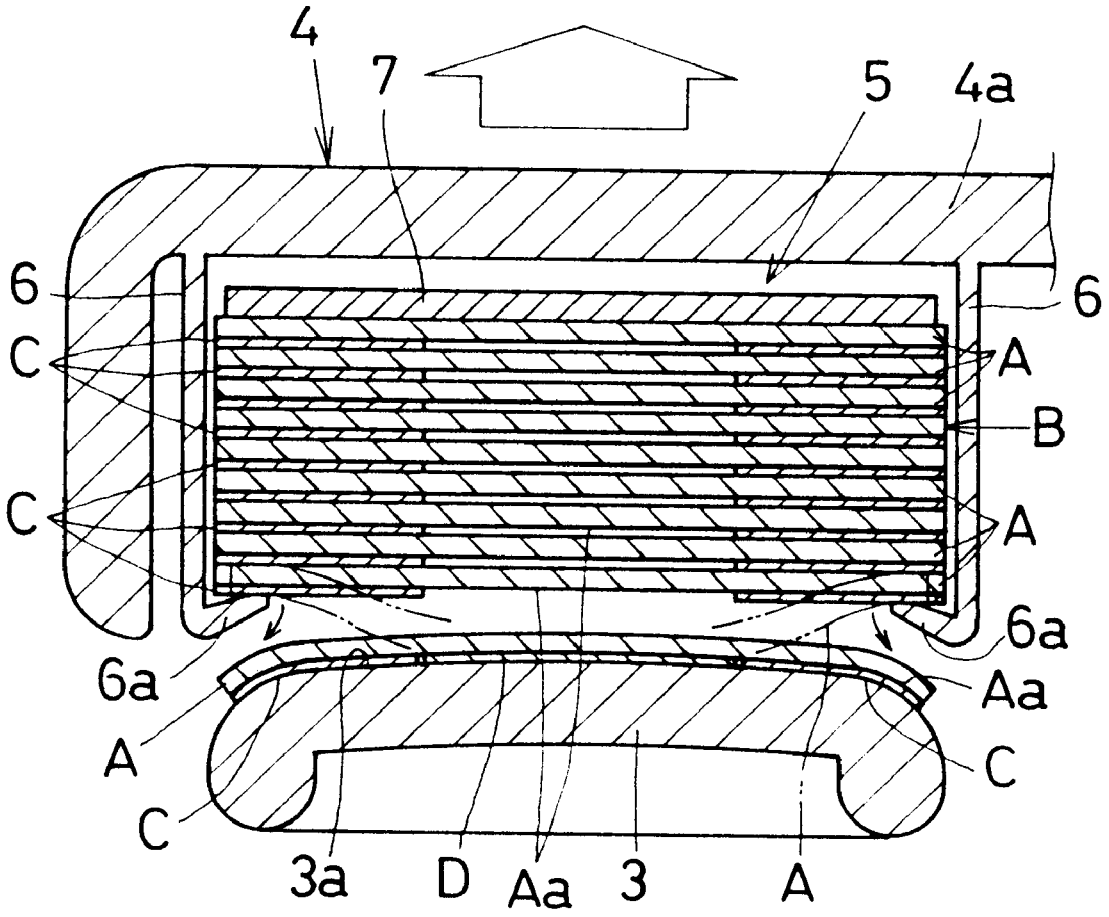
FIG. 5 is a sectional view showing the state of toilet seat sheet laid down on the sitting side of the toilet seat.

On the other hand, at the sitting side 3*a* of the toilet seat 3, as shown also in FIG. 5, an adhesive D is applied in part or in whole opposite to the adhesive side Aa of the sheet A of the lowest layer mounted on the sheet mounting unit 5 of the toilet lid 4. This adhesive D is set at an adhesion stronger than the adhesion of the adhesive C applied on the adhesive side Aa of the sheet A so as to adhere and fix the sheet A to the sitting side 3*a* of the toilet seat 3. Instead of the adhesives C, D, other adhering means may be also used, such as both-side adhesive tape or fastener.

In the embodiment thus constituted, the operation is described below.

Figure 4:
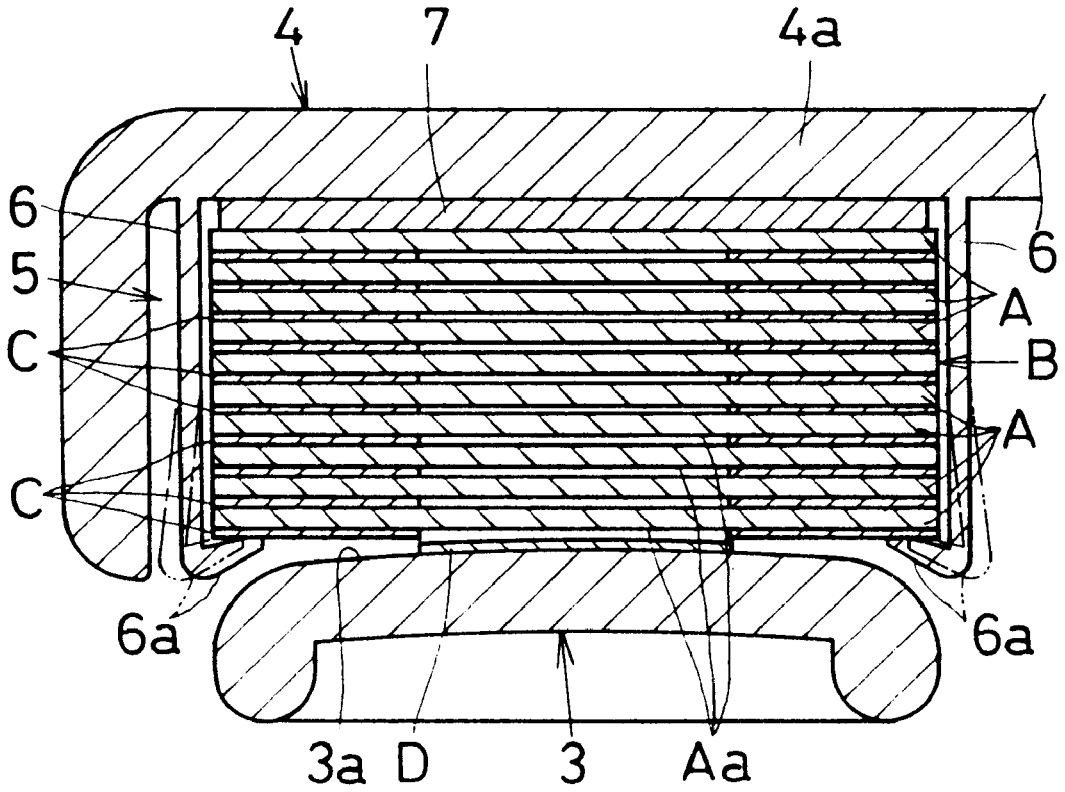
FIG. 4 is a sectional view showing the state of toilet seat sheet confronting the sitting side of the toilet seat.

First, as shown in FIG. 1 and FIG. 2, the toilet lid 4 is turned downward in the direction opposite to the sitting side 3*a* of the toilet seat 3 to push the sheet A of the lowest layer mounted on the sheet mounting unit 5 against the sitting side 3*a*, then since the adhesion of the adhesive D applied to the sitting side 3*a* is stronger than the adhesion of the adhesive C applied to the adhesive side Aa of the sheet A, as shown in FIG. 4 and FIG. 5, by synergistic action of the adhesives C, D, one sheet A in the lowest layer mounted on the sheet mounting unit 5 is separated, and the sheet A laid down accurately and securely so as to cover the entire sitting side 3*a* of the toilet seat 3.

Besides, since the installation state of the sheet A a adhered on the sitting side 3*a* of the toilet seat 3 is held by the adhesion of the adhesives C, D, when the user sits on the toilet seat 3, the sheet A is not curled up or deviated in position of installation, and the user sits on the sheet A laid down on the sitting side 3*a* of the toilet seat 3, so that contact of the user's buttocks with the toilet seat 3 is securely prevented so as to be used in clean and sanitary state.

After use or before use, when peeling off the used sheet A from the toilet seat 3, the tab Ab formed in the sheet A is held by the finger or the edge of the sheet A is held, and the sheet A is separated sequentially from the end by resisting the adhesion of the adhesives C, D, and the resistance felt when peeling is small, and the sheet A can be separated easily and readily. After separating the used sheet A, it is discarded by, for example, putting into waste basket or washing away together with the dirt. Then, by similarly turning the toilet lid 4, the sheet A of next layer mounted on the sheet mounting unit 5 is laid down on the sitting side 3*a* of the toilet seat 3, and therefore sheets A can be exchanged easily. When the sheets A mounted on the sheet mounting unit 5 of the toilet lid 4 are used up, a next sheet block B laminating a plurality of sheets A . . . is mounted on the sheet mounting unit 5 and used.

In this way, since the sheet A of the lowest layer mounted on the sheet mounting unit 5 of the toilet lid 4 is laid down on the sitting side 3*a* of the toilet seat 3 by turning the toilet lid 5 in a direction opposite to the sitting side 3*a* of the toilet seat 3, the time and labor of the user for laying down the sheet by hand as in the prior art can be omitted, and the sheet A may be laid down accurately and securely to cover the sitting side 3*a* of the toilet seat 3, so that the sheet A may be laid down easily and readily. Besides, after separating the used sheet A from the sitting side 3*a* of the toilet seat 3, the toilet lid 4 is turned to open or close, and the sheet A of next layer mounted on the sheet mounting unit 5 is laid down on the sitting side 3*a* of the toilet seat 3, so that the sheets A can be exchanged easily. Since the user sits on the sheet A laid down on the sitting side 3*a* of the toilet seat 3, contact of user's buttocks with the toilet seat 3 can be securely prevented, so as to be used in clean and sanitary state.

Besides, by the adhesion of the adhesive C applied to the adhesive side Aa of the sheet A and the adhesive D applied on the sitting side of the toilet seat 3, since one sheet A of the lowest layer mounted on the seat mounting unit 5 of the toilet lid 4 is separated, and the sheet A fixed in a state for covering the sitting side of the toilet seat 3 , when the user sits on the toilet seat 3, the sheet A is not curled up or deviated in position of installation, so that contact of the user's buttocks with the sitting side 3*a* of the toilet seat 3 is securely prevented.

The tab Ab formed in the sheet A is held by the finger, and the used sheet A laid down on the sitting side of the toilet seat 3 is separated sequentially from the end, and therefore the resistance felt when peeling is small, and the sheet A can be separated easily and readily. Or, by holding the tab Ab by finger, the used sheet A is discarded by, for example, putting into waste basket or washing away together with the dirt, and therefore contamination of the hand or fingers with germs can be securely prevented, and handling or disposal of the used sheet A is easy and sanitary.

Figure 6:
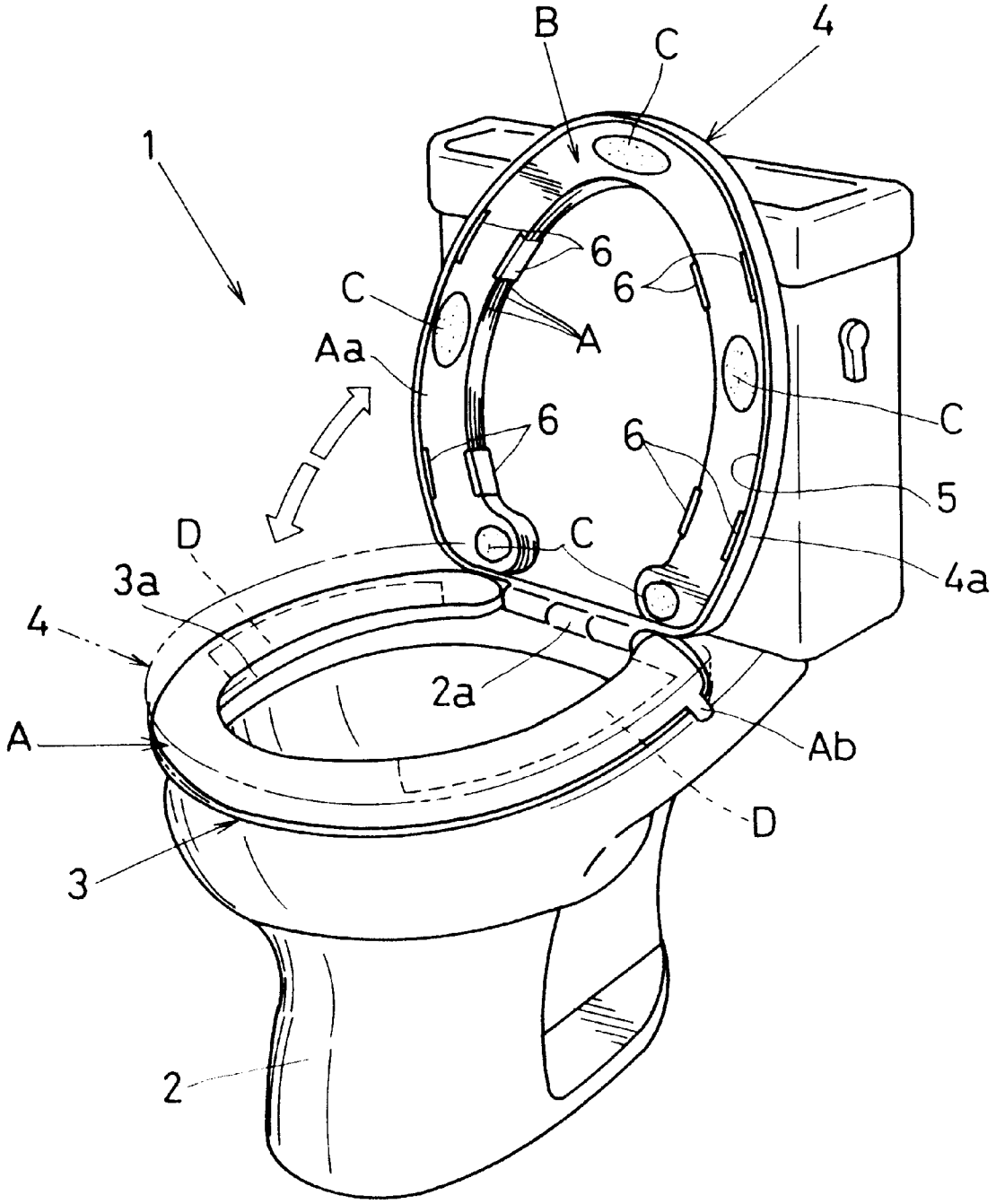
FIG. 6 is a perspective view showing other example of laying down the toilet seat sheet.

FIG. 6 shows other embodiment, in which an adhesive C is applied partly on the adhesive side Aa of the sheet A, and an adhesive D is applied on the sitting side 3*a* of the toilet seat 3 in a range (wide range) wider than the area of the adhesive C applied on the sheet A and necessary for laying down and fixing. Since the area of the adhesive D applied on the toilet seat 3 is wider than the area of the adhesive C applied on the sheet A, a necessary and sufficient adhesion for separating one sheet A of the lowest layer mounted on the sheet mounting unit 5 of the toilet lid 4 is obtained, and the sheet A is securely laid down on the sitting side 3*a* of the toilet seat 3, so that the same action and effect as in the above embodiment are obtained.

Figure 7:
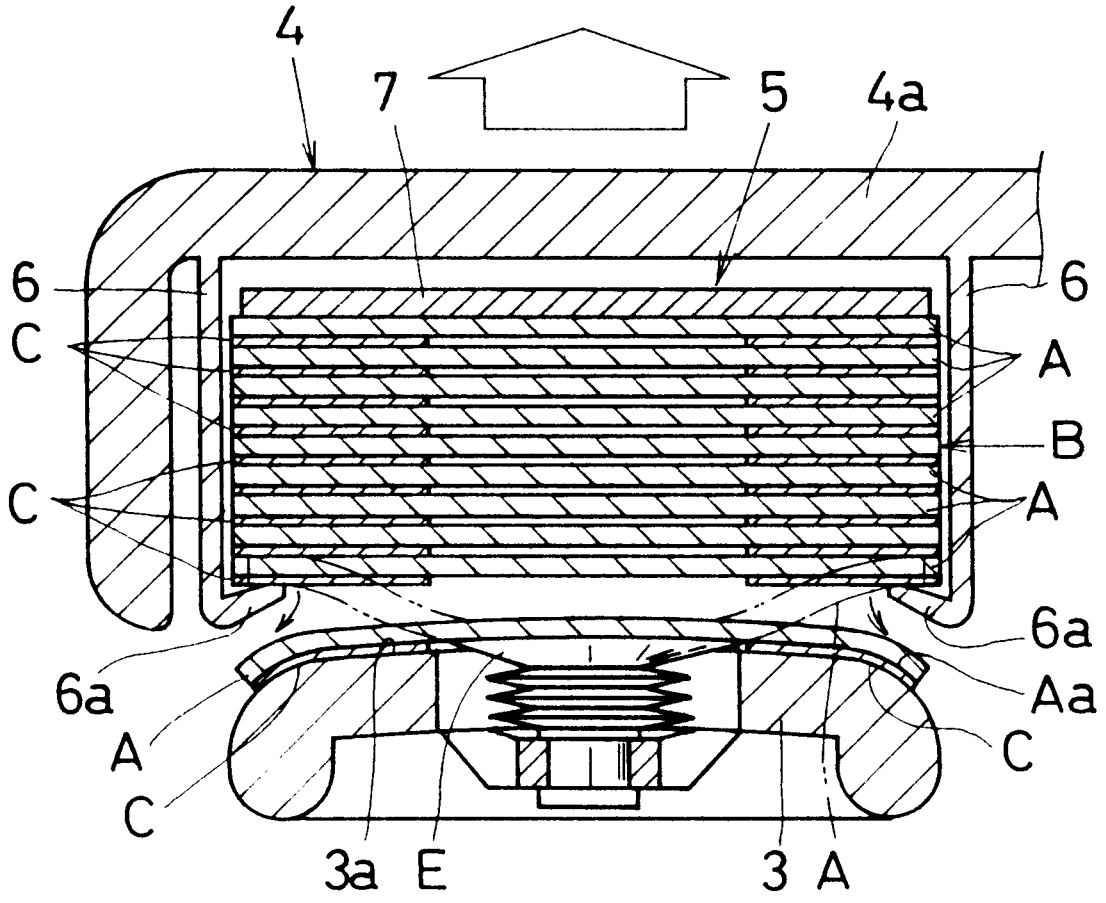
FIG. 7 is an essential sectional view showing other embodiment of toilet seat sheet holding structure.

FIG. 7 shows a different embodiment, in which the sheet A is sucked and held by a suction element E buried in the sitting side 3*a* of the toilet seat 3. By turning the toilet lid 4 in a direction opposite to the sitting side 3*a* of the toilet seat 3, when the sheet A of the lowest layer mounted on the sheet mounting unit 5 of the toilet lid 4 is pressed against the suction element 8 buried in the sitting side 3*a* of the toilet seat 3, by the negative pressure (suction force) generated on the suction side of the suction element 8, one sheet A of the lowest layer mounted on the sheet mounting unit 5 of the toilet lid 4 is separated, and the sheet A is sucked and held in a state for covering the sitting side 3*a* of the toilet seat 3, so that the same action and effect as in the above embodiments are obtained.

Figure 8:
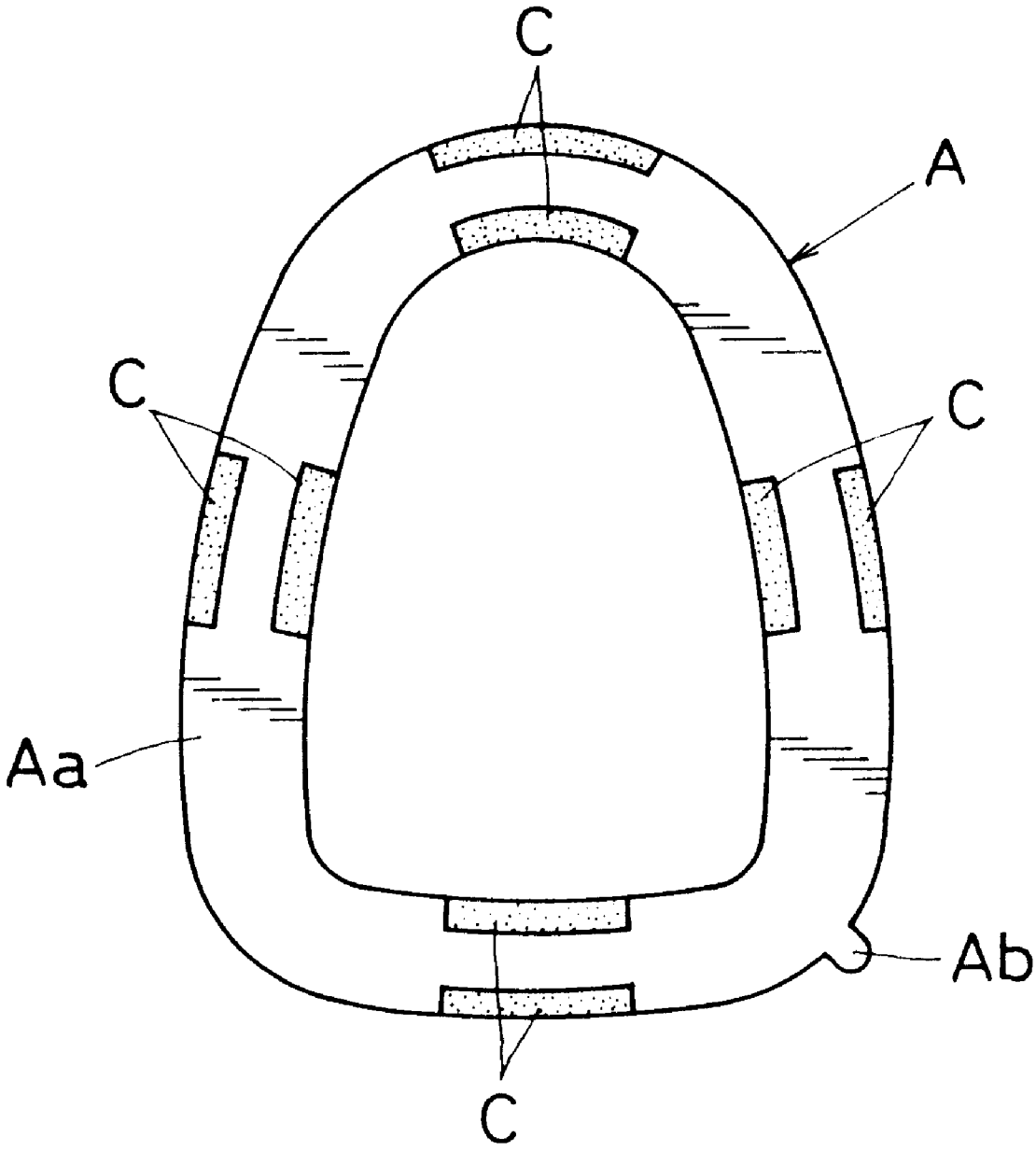
FIG. 8 is a plan view showing the toilet seat sheet shaped in a ring form.
Figure 9:
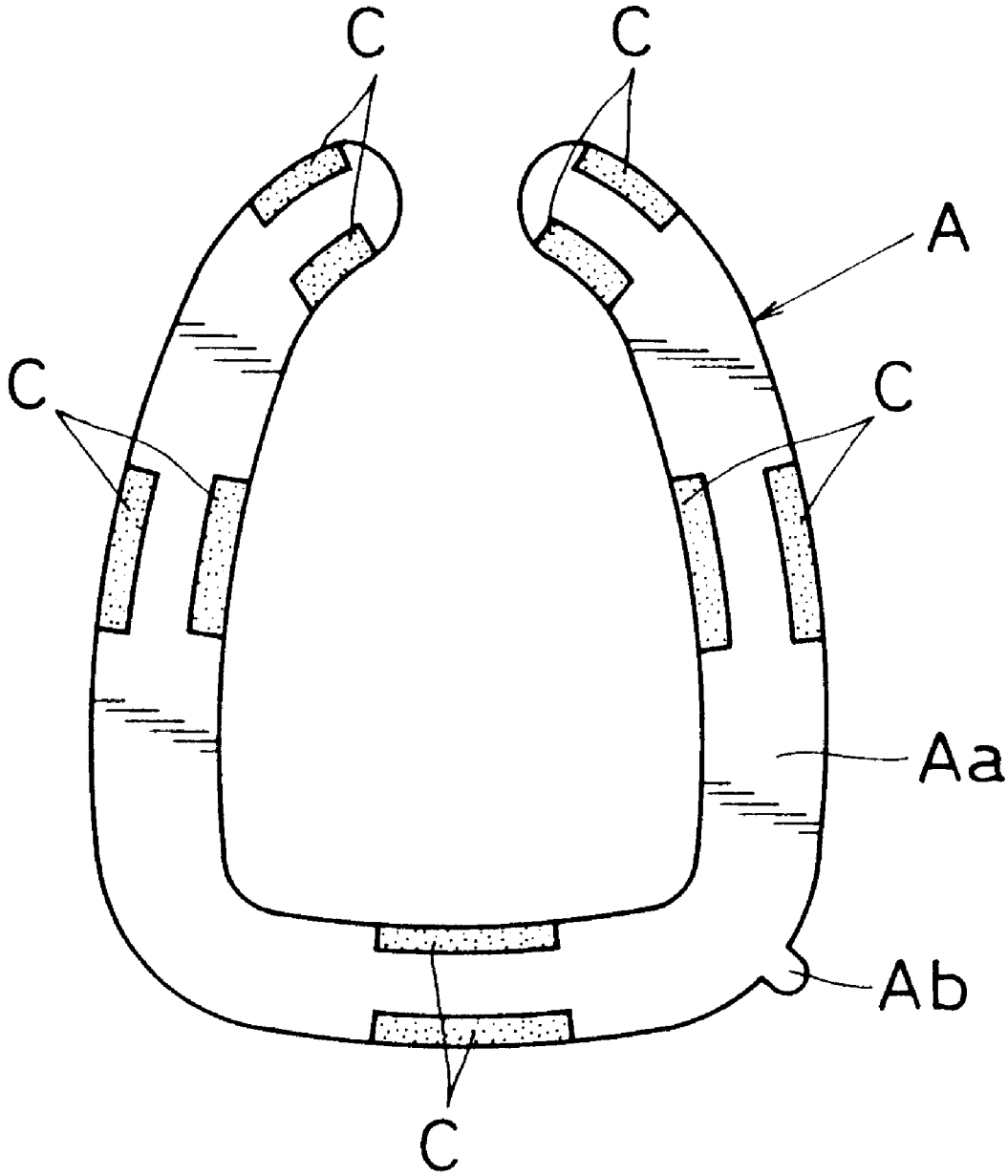
FIG. 9 is a plan view showing the toilet seat sheet shaped in a front end open form.

FIG. 8 and FIG. 9 show the structure of the sheet A differing in shape, and as shown in FIG. 8, on the sitting side 3*a* of the toilet seat 3 having a ring shape (ellipse), a sheet A formed in a size and shape corresponding to the sitting side 3*a* is laid down, or as shown in FIG. 9, on the sitting side 3*a* of the toilet seat 3 having a free end open shape, a sheet A formed in a size and shape corresponding to the sitting side 3*a* is laid down. Or a sheet A divided into right and left halves may be laid down.

Figure 10:
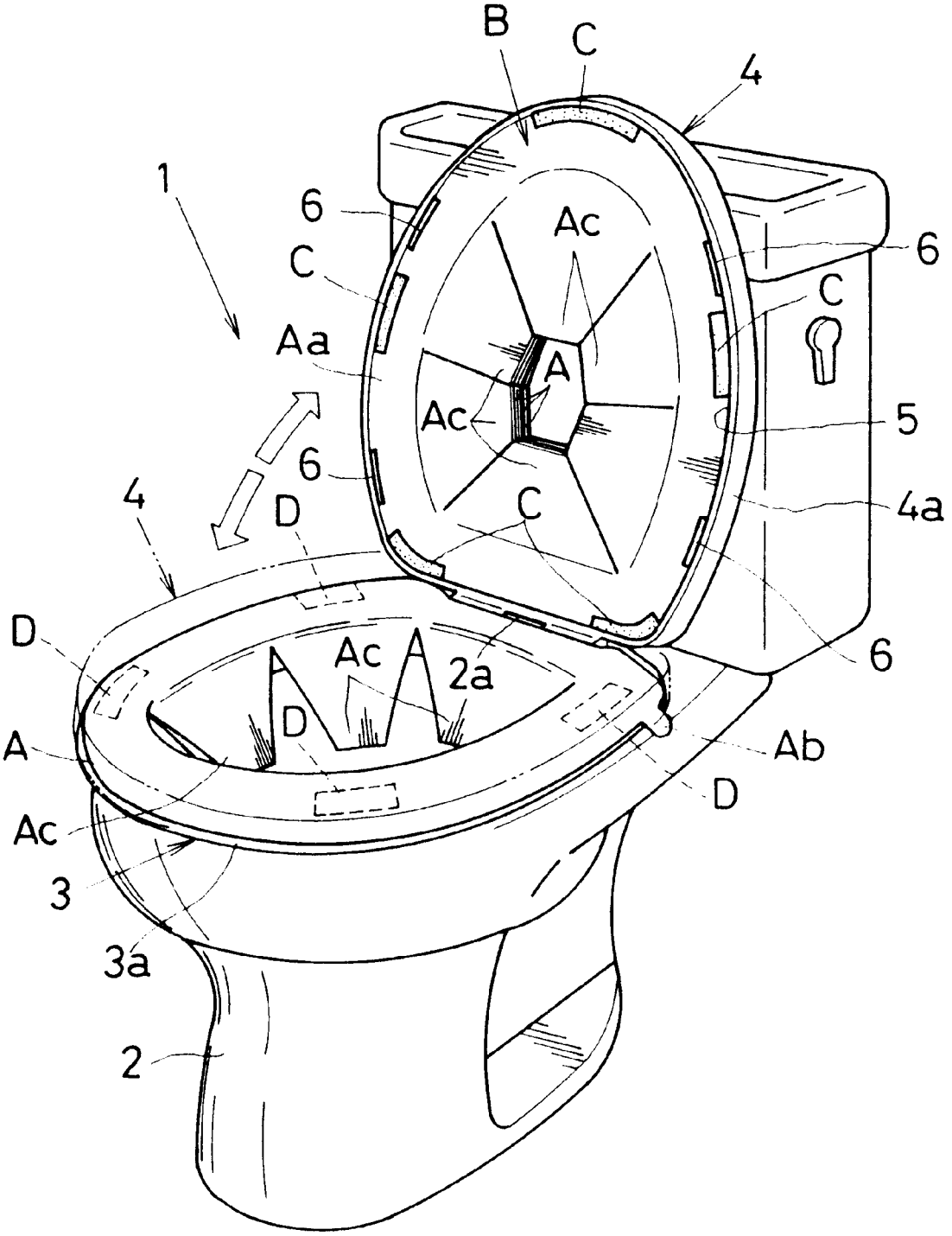
FIG. 10 is a perspective view showing a different embodiment of toilet seat sheet holding structure.

FIG. 10 shows a further different embodiment of the toilet seat sheet holding structure, in which a nearly elliptical sheet A formed in a size and shape or covering the entire surface of the toilet seat 3 is laid down. By turning the toilet lid 5 in a direction opposite to the sitting side 3*a* of the toilet seat 3, and laying down the sheet A of the lowest layer mounted on the sheet mounting unit 5 of the toilet lid 4 on the sitting side 3*a* of the toilet seat 3, folding pieces Ac . . . formed in the center of the sheet A are folded inside by the own weight, and the user folds the folding pieces Ac . . . inside by hand to open the center of the sheet A in a size corresponding to the inner circumference of the toilet seat 3, so that contamination of the toilet main body 2 and the inner circumference of the toilet seat 3 with the dirt can be prevented, and it can be used always in clean state.

Figure 11:
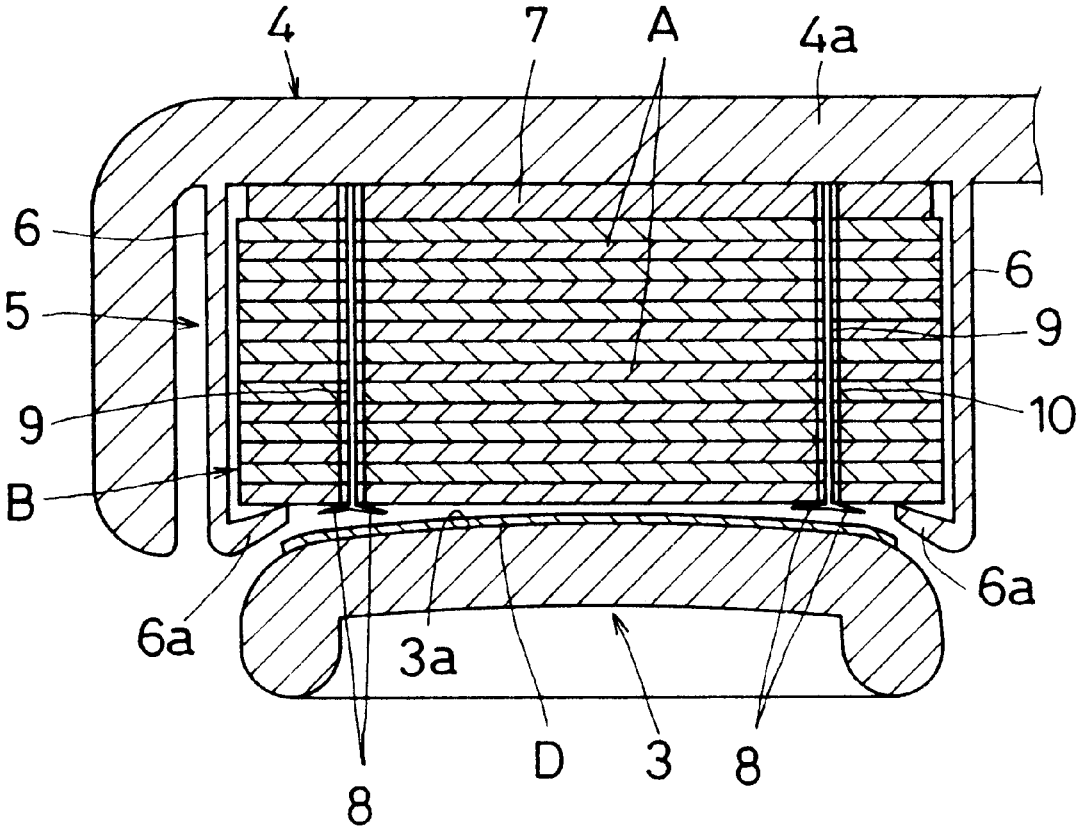
FIG. 11 is an essential sectional view showing another embodiment of toilet seat sheet holding structure.

FIG. 11 shows a still different embodiment of the toilet seat sheet holding structure, in which the adhesive C shown in FIG. 4 and FIG. 5 is omitted, and plural sheets A . . . laminated on the sheet mounting unit 5 are held so as to be separated into each one by a necessary number of holding members 9 having plural opening and closing pawls 8 . . . at the lower end.

That is, holes 10 are formed in the sheet a and weight member 7, and holding members 9 formed integrally or detachably in the lid main body 4*a* of the toilet lid 4, and the opening and closing pawls 8 . . . are formed in one body or integrally at the lower end of the holding members 9, and the plural opening and closing pawls 8 . . . are set in normally open state, and the sheet block B is held by the opening and closing pawls 8 . . . , and when laying down the sheet a of the lowest layer on the sitting side 3*a* of the toilet seat 3, the plural opening and closing pawls 8 . . . are closed, thereby permitting separation of one sheet A of the lowest layer. The opening and closing pawls 8 and the holding members 9 are preferably formed integrally with synthetic resin.

When thus constituted, by the holding members 9 of simple constitution, plural sheets A can be held so as to be separated into each one. In other respects, the action and effect are nearly same as in the embodiment shown in FIG. 4 and FIG. 5, and therefore, in FIG. 11, same reference numerals are given to the corresponding parts in the preceding drawings, and detailed description is omitted.

Figure 12:
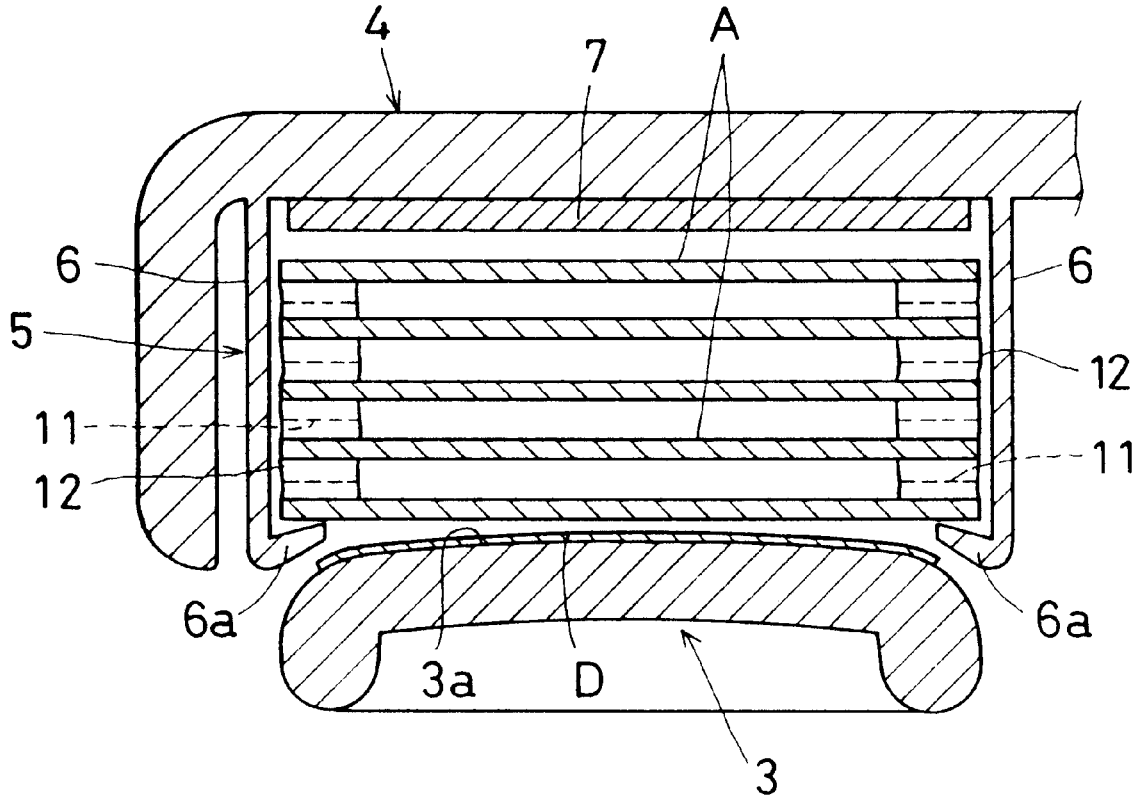
FIG. 12 an essential sectional view showing a further different embodiment of toilet seat sheet holding structure.

FIG. 12 shows another different embodiment of toilet seat sheet holding structure, in which plural sheets A, A set in the sheet mounting unit 5 are linked up and down with a necessary number of coupling pieces 12 having perforation 11 (tear-off line), and by the holding force of sheet holding means (see adhesive D) applied on the sitting side 3*a* of the toilet seat 3, the perforation 11 is torn off, and only one sheet A of the lowest layer is separated.

In this constitution, too, the action and effect are nearly same as in the embodiment shown in FIG. 4 and FIG. 5, and therefore, in FIG. 12, same reference numerals are given to the corresponding parts in the preceding drawings, and detailed description is omitted, and more preferably the coupling pieces 12 should be made of same material as the sheet A. In FIG. 12, for the convenience of illustration, each sheet A and weight member 7 are shown as being separated up and down, but they are actually joined up and down.

In the correspondence between the constitution of the invention and the foregoing embodiments, the sheet holding means of the invention corresponds to the adhesives C, D and suction element E in the embodiments, and similarly, the opening and closing parts correspond to opening and closing pawls 8, but it must be noted that the invention is not limited to the illustrated embodiments alone.

What is claimed is:

1. A toilet seat and cover unit comprising:

a toilet seat having an upper surface on which a human sits;

a cover which is movable to cover said toilet seat in a closed position and to expose said upper surface of said toilet seat in an open position, wherein said cover has a top surface in said closed position;

first means attached to said cover for holding a plurality of sheets of a dimension and shape suitable for coveriing at least said upper surface of said toilet seat, said first means comprising:

second means disposed toward said top surface of said cover for providing a force against said plurality of sheets, and first set of pawls disposed away from said top surface of said cover for holding opposite edges of said pluraliyt of sheets, whereby said second means applies force to said plurality of sheets against said first set of pawls when said cover is in a closed position; and third means for causing removal of a bottom most sheet from said plurality of sheets and attachment thereof to said upper surface of said toilet seat when said cover is moved to said closed position, said third means comprising adhesive applied to at least a part of said upper surface of said toilet seat, and adhesive applied to at least part of a bottom surface of each of said plurality of sheets, and wherein holding power of adhesive applied to said upper surface of said toilet seat is greater than holding power of adhesive applied to said plurality of sheets.

2. The unit of claim 1, wherein said adhesive is applied to all of the upper surface of said toilet seat.

3. The unit of claim 1, wherein said plurality of sheets are individual sheets.

4. The unit of claim 1, wherein each of said plurality of sheets comprises a tab located at an edge thereof and holdable by a human hand to provide easy removal of said sheet from said upper surface of said toilet seat against any holding force.

* * * * *